United States Patent [19]

Roullier

[11] 4,175,479

[45] Nov. 27, 1979

[54] CIGARETTE-FILTER-MAKING APPARATUS

[75] Inventor: Marcel-Francois Roullier, Preverenges, Switzerland

[73] Assignee: Baumgartner Papiers S.A., Crissier, Switzerland

[21] Appl. No.: 914,418

[22] Filed: Jun. 12, 1978

[30] Foreign Application Priority Data

Jun. 21, 1977 [CH] Switzerland ..... 7626/77

[51] Int. Cl.[2] ..... A24C 5/50

[52] U.S. Cl. ..... 93/77 FT; 73/45.1; 131/23 R

[58] Field of Search ..... 93/77 FT; 83/79; 73/45.1, 45.2; 131/23 R

[56] References Cited

U.S. PATENT DOCUMENTS 3,270,551 9/1966 Schmalz ..... 73/45.1

*Primary Examiner*—Robert D. Baldwin

*Attorney, Agent, or Firm*—Ernest F. Marmorek

[57] ABSTRACT

A cigarette-filter-making apparatus is comprising a pick-up drum rotatable about its longitudinal axis and provided along its circumference with longitudinally extending retaining grooves for the accommodation of individual filter sections and lateral delivery of them to a laterally adjacent discharge. For ejecting faulty filters the pick-up drum is provided with a guide element extending continuously from the pick-up point to the delivery station and ejector blasting means are provided to blow faulty filter sections out of the drum grooves in their longitudinal direction.

7 Claims, 2 Drawing Figures

CIGARETTE-FILTER-MAKING APPARATUS

FIELD OF INVENTION

This invention concerns cigarette-filter-making apparatus comprising means for forming a continuous cigarette filter string, severing means for splitting said string into separate filter sections of predetermined length, a pick-up cylinder or drum rotatable about its longitudinal axis and provided with circumferential grooves extending in its longitudinal direction to receive and hold the individual filter sections, for their lateral delivery from said grooves on to a laterally adjacent discharge device, and control means for continuously controlling the cigarette filter string and/or the individual filter sections before they enter into the receiving grooves on the pick-up drum.

BACKGROUND OF THE INVENTION

The prior art already comprises a cigarette-filter making apparatus wherein, after the formation of a continuous cigarette-filter string the latter is cut up by severing means into individual filter lengths which are delivered individually to a circumferentially longitudinally grooved dispensing cylinder for subsequent lateral discharge to a conveyor belt. In this arrangement the filter string is checked forwardly of the severing station by means of a quality control system which actuates a pneumatically operated ejector device arranged partly within the interior of the hollow cylinder. The ejector device comprises a stationary part extending over a portion of the inner circumferential wall of the cylinder in sealed engagement therewith to form a chamber which communicates via radial bores with a portion of the receiving grooves, said stationary part being adapted to be alternatively connected with low or high pressure sources. Switchover from low to high pressure source connection and vice versa is controlled by the quality control device in such a fashion that in the presence of perfect filter strings a partial vacuum or low pressure, and for faulty filter strings a high pressure for ejecting the faulty filter lengths is applied to the work-receiving grooves via said chamber inside the cylinder which communicates therewith. However, this existing apparatus has the disadvantages of a complicated and expensive construction, presenting a comparatively large number of parts which are subject to wear and being unsuitable for the aimed elimination of only a few individual filter sections.

SUMMARY OF THE INVENTION

The present invention aims to provide apparatus of the kind specified which is not afflicted by the above listed disadvantages appertaining to the existing arrangement that is to say, which is simple and inexpensive to make with easy maintenance whilst being very precisely controllable.

The invention achieves this aim in apparatus of the kind specified thanks to the provision on the pick-up drum of a guide element extending continuously along a cylindrical surface from the pick-up point to the delivery point of the drum, viewing in the direction of rotation of the latter, to prevent the filter sections from dropping out of the receiving grooves, and to the provision of ejector blower means outside of the drum and associated with the control means for controlled actuation by the latter to blow filter sections out of the longitudinal grooves of the pick-up drum in the direction of the length of said grooves.

For regular alignment of the filter sections relative to and on the pick-up drum it is advisable to provide filter-section stop faces at the end of the grooves which is opposite the entrance end, and in this connection it is an advantage if second blower means are provided which are directed towards this stop face and arranged immediately behind the pick-up point, viewed in the direction of drum rotation, to deliver at least one air jet for pushing the filter sections back in their grooves until they engage with said stop face.

It is advisable to arrange the ejector blastmeans behind the pick-up point but forwardly of the delivery station, viewed in the direction of rotation of the drum, and preferably in the form of an air jet nozzle directed frontally into the pick-up grooves moving past. For the evacuation of ejected filter lengths it is an advantage to provide a discharge or ejector funnel on the rear end side of the pick-up drum which is averted from the ejector blast means, the intake opening of said funnel being arranged in prolongation of the receiving groove to which the ejector blast means are applied for the reception of filter section which are ejected from the grooves by the ejector blast means.

For re-aligning any filter sections on the pick up drum which may have been displaced by the ejector blast means prior to their lateral deposition on a discharge system such as for example a conveyor belt, it is advisable to provide further blasting means behind the ejector blast means but forwardly of the pick-up drum delivery station, viewed in the direction of drum rotation, to provide an air jet for pushing the filter sections right back against the stop or end faces in the respective groove.

BRIEF DESCRIPTION OF THE DRAWINGS

The invention is hereinafter more specifically explained by way of example with reference to the accompanying drawings wherein.

DETAILED DESCRIPTION

Figure 1:
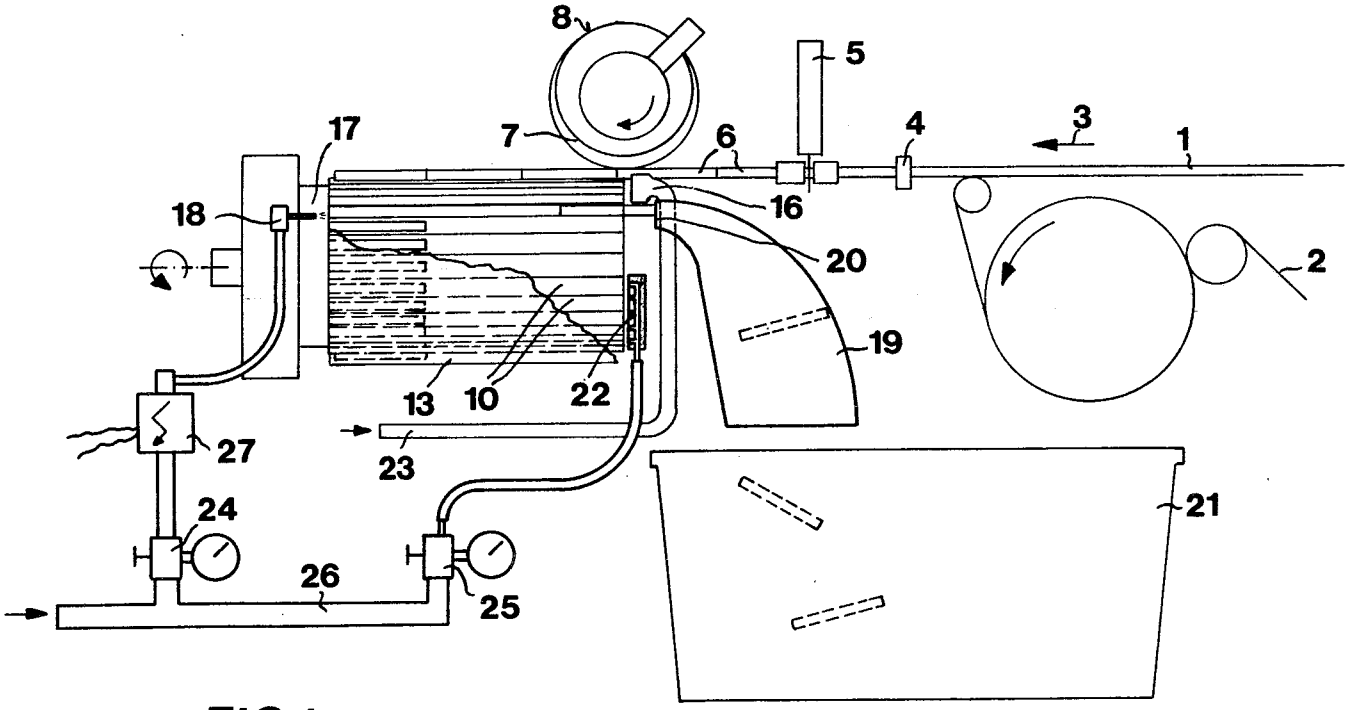
FIG. 1 is a lateral elevation of an apparatus embodying the present invention.

The drawings show that the filter string 1 which is produced in conventional manner, is conducted by means of an endless conveyor belt 2 forwardly in direction of arrow 3 through an annular control- or measuring head 4 wherein it is checked for production faults or defects and subsequently cut up into individual and separate filter sections 6 by means of a blade 5 which is rotatable about a horizontal axis.

These filter sections 6 are then successively picked up by a guide wheel 8, rotatable about a horizontal axis and provided with a helical groove 7, the drive for said wheel 8 being synchronized with the pick-up drum drive in such a way that the individual filter sections 6 will be inserted precisely into the retaining grooves 10 of the revolving pick-up drum 9 by the guide wheel 8, in per se conventional fashion. It will be noted from FIGS. 1 and 2 that the pick-up drum 9 is rotatable about a horizontal axis which is normal to the rotation axis of the guide wheel 8 and that the drum circumference is provided with longitudinally extending grooves 10 for the accommodation of the filter sections 6.

Figure 2:
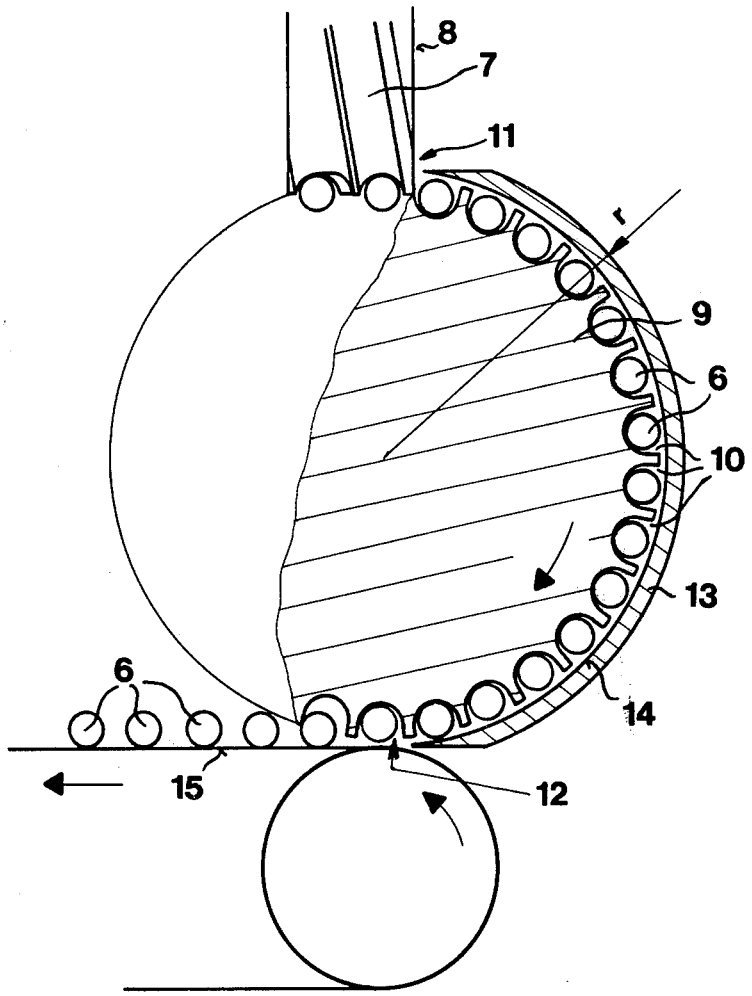
FIG. 2 is a section taken on line II—II in FIG. 1.

FIG. 2 shows best that the pick-up drum 9 is provided with a guide element 13 which extends over a cylindrical surface from the pick-up point 11 to the delivery station 12, viewing in the direction of drum rotation, to prevent the filter sections 6 from dropping out of the retaining grooves 10, the longitudinal axis of said cylindrical surface coinciding with the rotation axis of the drum 9. The radius r of the inwardly directed operative face 14 of the guide element 13 is selected of such value as to ensure that during rotation of the drum 9 the filter sections 6 in the retaining grooves 10 of the drum will not be squeezed or wedged between the drum and the guide element 13, but, on the other hand, that they cannot drop out of the grooves 10. The best way to ensure both these objectives is to provide a minimum clearance between the filter sections 6 in their retaining grooves 10 and the operative face 14 of the guide element 13. To reduce friction, the said operative face 14 of the guide element 13 may also be provided with a coating, e.g., of Teflon, having a lower friction coefficient than the outside of the filter sections 6.

At the delivery station 12 of the pick-up drum 9 the filter sections 6 drop freely out of the drum grooves to land on an endlessly rotating horizontal conveyor belt 15 which extends at right angles to the length of the filter string 1 and conveys the filter sections 6 towards a collecting and packing station.

In order to make absolutely sure that at the delivery station 12 all filter sections are accurately lined up with the conveyor belt 15 an air jet or nozzle 16 is provided immediately behind the pick-up point 11, as viewed in the direction of rotation of the pick-up drum 9, said air jet 16 being effective in the direction of filter section advancement so that all filter sections 6 which were introduced into the retaining grooves 10 of the drum will be safely carried by the stream of air directed at their frontal sides by the jet 16 to the left hand side, as shown in FIG. 1 until they engage with an end stop provided at this left hand end of the retaining grooves 10. In the illustrated example a collar 17 of the drum 9 forms the end stop in question. The air nozzle 16 is of comparatively wide or broad form and extends simultaneously over several filter sections 6 retained in the grooves 10 of the drum 9.

Behind the air jet 16, viewing in the direction of drum rotation,-which jet 16 has the function to align the individual filter sections 6 on the drum 9, - an ejector air jet 18 is arranged on the opposite end of the drum 9 in such a way as to be effective in the opposite direction to the direction of advancement 3 of the filter string 1, with its outlet opening directed at the left hand end faces (FIG. 1) of the filter sections 6 which move past this jet on rotation of the drum 9. For maximum accuracy of the ejection process the diameter of the outlet opening of jet 18 is smaller than the diameter of the retaining grooves 10, and should preferably be as small as possible in order to produce the finest possible airstream because this is the only way of reducing the number of filter sections which have to be ejected in the event of a fault being detected by the quality control device 4.

For carrying away the filter sections 6 which are to be ejected by the air jet 18 from the grooves 10, an evacuation funnel 19 is provided on the rear side of the drum 9 which is averted from the ejector jet 18, the intake opening 20 of said funnel 19 being directed towards the entrance end of the grooves 10 and arranged in such a way that filter sections 6 which are blown out of the grooves 10 by air jet 18 will enter into this intake opening 20 of the evacuation funnel 19 to be conducted by the latter into a suitable collecting vessel 21, for example.

As it may happen during the starting and stopping of the ejector jet 18 that a single filter section 6 is just pushed to the right hand side in its groove 10 (FIG. 1), but not fully ejected, an aligning air jet 22 spanning the frontal entry sides of several retaining grooves 10 is provided on the right hand frontal side of the drum 9 between the ejector jet 18 and the delivery station 12 (in FIG. 2), as viewed in the direction of drum rotation, to deliver a current of air directed at the grooves 10 which ensures that all filter sections 6 are fully applied to the left hand end stop 17 of the retaining grooves 10 before they arrive at the delivery station 12 and consequently correctly lined up relative to the conveyor belt 15.

The air jet 16 is supplied via 23 with air from the fan associated with the driving motor of the cigarette-filter making machine.

The two air jets 18 and 22 are supplied via adjustable pressure reducing valves 24 and 25 and compressed air supply 26 with compressed air. For optional application of the ejector jet 18 an electro-magnetically operated magnetic valve 27 which is controlled by an electric control circuit activated by the quality control device 4, is provided between the jet 18 and the pressure reducing valve 24.

A single filter section 6 consists in the present example of a length of filter string or rod equivalent to six individual cigarette filters, as is customary in the cigarette-producing industry.

The filter string 1 may consist, for example of successively lined up filter plugs made of different materials in alternate sequence, such as for example cellulose and acetate, and enveloped in an outer paper sleeve, or of chamber filter units.

It has already been mentioned that the filter string 1, after having been made up, is conducted through an annular quality control device 4 which ascertains, e.g., by means of light beams directed transversely through the string 1 and photosensitive receiver elements, whether the successive filter plugs in the interior of the string 1 are closely packed, i.e., without clearance, or individual filter plugs are undesirably spaced apart, or if the alternating sequence of filter plugs made from different materials is incorrect.

In the production of filter rods- or sections 6 designed for chamber filters the quality control device 4 may also be adapted to check the size of the granulate-filled chambers and the amount of filling in individual chambers.

If the control device 4 detects an inadmissible defect or irregularity in the filter string 1 which passes continuously through this device, the output signal of the quality control device 4 actuates an electric control circuit to activate the magnetic valve 27 with a slight time lag to effect the elimination of the defective filter sections 6. The time lag between the fault detection in the control device 4 and the opening of the magnetic valve 27 is selected with a view to safety in such a way that approximately3 to 5 further filter sections 6 preceding and following the detected defective filter section 6 will also be ejected from the retaining grooves 10 of the pick-up drum 9.

With the aid of the above described apparatus any filter sections 6 which have been detected to be defective can be very simply and with a high degree of accuracy eliminated from the production process.

What I claim is:

1. Cigarette-filter-making apparatus comprising means for forming a cigarette-filter-string, separating means for cutting the cigarette-filter-string into individual filter sections of a given length, a pick-up drum rotatable about its longitudinal axis and provided along its circumference with longitudinally extending retaining grooves for the accomodation of the individual filter sections and lateral delivery of the filter sections retained in said grooves to a laterally adjacent discharge as well as quality control means for continuously controlling the cigarette-filter string and/or the individual filter sections prior to their delivery into the retaining grooves of the pick-up drum, characterised in that the pick up drum (9) is provided with a guide element (13) extending continuously over a cylindrical surface from the pick-up point (11), to the delivery station (12) of the drum (9), viewing in the direction of drum rotation, to prevent the filter sections (6) from dropping out of the retaining grooves (10), and in that ejector blasting means (18) are provided outside of the drum which are operatively associated with the quality control device (4) and controlled by the latter to blow filter sections (6) out of the retaining grooves (10) on the drum (9) in the longitudinal direction of said grooves.

2. Apparatus according to claim 1, characterised in that the retaining grooves (10) are provided with end stops (17) for the filter sections (6) at the groove ends which are remote from the entry ends thereof.

3. Apparatus according to claim 2, characterised in that second blasting means (16) which are directed at the end stops (17) are provided immediately behind the pick-up point (11), as viewed in the direction of rotation of the pick-up drum (9), for pushing the filter sections (6) in the retaining grooves (10) by means of a current of air back in the groove until they engage with the end stop (17).

4. Apparatus according to claim 3, characterised in that the second blasting means (16) are arranged at the frontal side of the pick-up drum (9) which contains the entrances to the retaining grooves (10).

5. Apparatus according to one or more of the preceding claims, characterised in that the ejector or blasting means, preferably in the form of an air jet (18) directed frontally into the retaining grooves (10) which travel past the het (18), are arranged behind the pick-up point (11) but forwardly of the delivery station (10) as viewed in the direction of rotation of the pick-up drum (9).

6. Apparatus according to claim 5, characterised in that an ejection discharge funnel (19) is provided on the frontal side of the pick-up drum (9) which is averted from the ejector blasting means (18), the intake opening (20) of which funnel (19) is adapted to receive filter sections (6) which are ejected from the grooves (10) by the ejector blasting means (18) in prolongation of the retaining groove (10) which is subject to the action of the ejector blasting means (18).

7. Apparatus according to claim 2, characterised in that further blasting means (22) are provided behind the ejector blasting means (18) but forwardly of the delivery station (12) of the pick-up drum (9), viewing in the direction of drum rotation, for pushing filter sections (6) in the retaining grooves (10) by means of at least one air jet into engagement with the end stop (17) provided at the respective end of the retaining grooves (10).

* * * * *